US012151881B2

(12) United States Patent
Jian et al.

(10) Patent No.: US 12,151,881 B2
(45) Date of Patent: Nov. 26, 2024

(54) CONTAINER

(71) Applicant: HOREN CORTP CO., LTD., Shanghai (CN)

(72) Inventors: Yuanli Jian, Shanghai (CN); Long Feng, Shanghai (CN)

(73) Assignee: HOREN CORTP CO., LTD., Shanghai (CN)

( * ) Notice: Subject to any disclaimer, the term of this patent is extended or adjusted under 35 U.S.C. 154(b) by 94 days.

(21) Appl. No.: 18/003,852

(22) PCT Filed: Jun. 30, 2021

(86) PCT No.: PCT/CN2021/103371
§ 371 (c)(1),
(2) Date: Dec. 29, 2022

(87) PCT Pub. No.: WO2022/002101
PCT Pub. Date: Jan. 6, 2022

(65) Prior Publication Data

US 2023/0278782 A1 Sep. 7, 2023

(30) Foreign Application Priority Data

Jul. 1, 2020 (CN) ..... 202010624947.5

(51) Int. Cl.
*B65D 90/58* (2006.01)
*B65D 90/08* (2006.01)

(52) U.S. Cl.
CPC ..... *B65D 90/587* (2013.01); *B65D 90/08* (2013.01); *B65D 2590/668* (2013.01)

(58) Field of Classification Search
CPC ..... B65D 90/587; B65D 90/08; B65D 2590/668; B65D 25/005;
(Continued)

(56) References Cited

U.S. PATENT DOCUMENTS 2,661,119 A 12/1953 Spiess, Jr. et al.
3,015,405 A 1/1962 Sterling
(Continued)

FOREIGN PATENT DOCUMENTS

CN 202508426 U 10/2012
CN 102807028 12/2012
(Continued)

OTHER PUBLICATIONS

International Search Report issued in International Application No. PCT/CN2021/103371, Aug. 30, 2021, 6 pages w/ translation.
(Continued)

*Primary Examiner* — James N Smalley
(74) *Attorney, Agent, or Firm* — HSML P. C.

(57) ABSTRACT

The present invention discloses a container, comprising a container body and a lid, the container body comprises a base and side plates, the lid is provided with a first hanging-against structure, the side plate is provided with a second hanging-against structure cooperating with the first hanging-against structure, the first hanging-against structure and the second hanging-against structure are separatable to achieve hanging-against and removal of the lid, the lid is slidable above the container body whereby the first hanging-against structure and the second hanging-against structure are brought close to or away from each other, wherein the first hanging-against structure is slidable along the lid for a certain distance so that the position of the center of gravity of the lid changes relative to the first hanging-against structure. The present invention can realize the multi-directional hanging function of the lid and the container, with novel and reliable structure, simple and convenient operation, solid and durable.

11 Claims, 10 Drawing Sheets

(58) Field of Classification Search
CPC ..... B65D 2519/00333; B65D 2519/00587; B65D 2519/00621; B65D 2519/00646; B65D 2519/00666; B65D 2519/00711; B65D 2519/009; B65D 19/06; B65D 90/54; B65D 90/00; B65D 90/582
See application file for complete search history.

(56) References Cited

U.S. PATENT DOCUMENTS

| | | | | |
|---|---|---|---|---|
| 4,048,050 | A * | 9/1977 | Hillman | B65D 50/045 220/812 |
| 5,251,775 | A | 10/1993 | Kruzick et al. | |
| 5,992,680 | A * | 11/1999 | Smith | B65F 1/1646 220/812 |
| 2011/0163109 | A1* | 7/2011 | Dunstan | E05D 15/582 220/810 |
| 2015/0239622 | A1* | 8/2015 | Jian | B65D 19/06 220/813 |
| 2019/0009947 | A1 | 1/2019 | Vandecasteele | |

FOREIGN PATENT DOCUMENTS

| | | | |
|---|---|---|---|
| CN | 202743649 | U | 2/2013 |
| CN | 2 868 592 | | 5/2015 |
| CN | 111776514 | | 10/2020 |
| DE | 10 2005 008 695 | | 8/2006 |
| EP | 2 256 050 | | 12/2010 |
| EP | 2537769 | A1 | 12/2012 |
| JP | 0377036 | U | 8/1991 |
| JP | 08244813 | A | 9/1996 |
| JP | 11299533 | A | 11/1999 |
| JP | 2003-026160 | | 1/2003 |
| JP | 2011157130 | A | 8/2011 |
| JP | 2011172774 | A | 9/2011 |
| JP | 2012131541 | A | 7/2012 |
| JP | 2019009947 | A | 1/2019 |

OTHER PUBLICATIONS

Office Action issued in corresponding Japanese Application No. 2022-581323, dated Dec. 19, 2023.
The extended European search report issued in European Application No. 21834042, dated Jun. 17, 2024.

* cited by examiner

CONTAINER

TECHNICAL FIELD

The present invention relates to the field of logistics and transportation, and in particular to a container.

TECHNICAL BACKGROUND

There is a new type of large container for turnover, the volume of such large container generally exceeds 250 liters, and is mainly used for cargo transportation and temporary storage. In order to meet the increasingly stringent requirements of cargo transportation and packaging, the humanized requirement of the operation process, as well as the control of costs, such large container generally has a base and four side walls. In order to reduce recycling costs, the four side walls of the container is foldable relative to the base; and in order to further ensure the safety of the cargo transportation process, such container is generally equipped with one lid. There are protruding edges around the lid, which are close to the outside of the four side plates of the container. When the goods inside the container exert a large force on the side plates, the protruding edges of the lid can protect the side plates to a certain extent. In addition, when the liquid or bulk goods inside the container fluctuate upward, the lid can limit the undulation of the liner bag containing them very well, thus also protecting the liner bag from being damaged. However, when operating the container each time, it is necessary to remove the lid from or assemble the lid to the top of the container, since the container itself is very large in length and width, almost no less than 1 meter, which makes the volume of the lid also very large and the weight of the lid often be designed to be more than 5 kg, so that the operation of opening or removing the lid is very hard and not humanized.

In order to improve the user's operating experience and work efficiency, our company proposed a lid structure that can be pushed-pulled and hung against the side plate. Its hanging-against structure comprises a hanging-against member and a hanging slot, the hanging-against member and the hanging slot are separatable to achieve the hanging-against and removal of the lid; and one of the hanging-against member and the hanging slot is located on one of the lid and the side plate, while the other of the hanging-against member and the hanging slot is located on the other of the lid and the side plate. In the lid hanging-against structure of the invention, the lid can be easily removed from the container body as needed, i.e., the lid can be removed directly when it is not hanged against the side plate and in use, and the lid can be removed with a simple action when it is in a hanging-against state. This reduces the labor, and the structure is simple and low in cost. However, due to its structural characteristics, the lid can only be opened and pushed or pulled on one side of the container, and the direction of operation is unchanged, it may reduce the efficiency of the user and can not provide enough perfect convenience.

Therefore, there is a need for a lid hanging-against structure, which has a simple structure and is easy to operate and use.

SUMMARY

An object of the present invention is to provide a container to solve the above-mentioned problems in the prior art.

In order to solve the above-mentioned problems, according to an aspect of the present invention, there is provided a container comprising a container body and a lid, the container body comprises a base and side plates, the lid is provided with a first hanging-against structure, the side plate is provided with a second hanging-against structure cooperating with the first hanging-against structure, the first hanging-against structure and the second hanging-against structure are separatable to achieve hanging-against and removal of the lid, the lid is slidable above the container body whereby the first hanging-against structure and the second hanging-against structure are brought close to or away from each other, wherein the first hanging-against structure is slidable along the lid for a certain distance so that the position of the center of gravity of the lid change relative to the first hanging-against structure.

In one embodiment, the first hanging-against structure comprises a hanging hook, the second hanging-against structure comprises a hanging slot provided on the side plate; or the first hanging-against structure comprises a hanging slot, the second hanging-against structure comprises a hanging hook provided on the side plate.

In one embodiment, the first hanging-against structure is movably provided in the lower surface of the lid, and the lid comprises a lid body and two opposite first protruding edges and two opposite second protruding edges surrounding the lid body, wherein the first hanging-against structure is provided on the inner side of each of the two opposite first protruding edges.

In one embodiment, a lower surface of the lid is provided with a mounting slot, which has a length extending along the first protruding edge, the first hanging-against structure is arranged within the mounting slot and capable of moving along the length of the mounting slot for a certain distance, wherein the mounting slot is provided on the middles of inner sides of the two opposite first protruding edges and spanning a midpoint of the first protruding edge, so that the first hanging-against structure is capable of moving within the mounting slot toward two ends of the first protruding edge and across the midpoint of the first protruding edge.

In one embodiment, the mounting slot is recessed inwardly from the lower surface of the lid body, and a width of a body portion of the mounting slot is greater than that of an opening portion thereof so as to form a flange protruding toward a center in the opening portion.

In one embodiment, the first hanging-against structure comprises a mounting portion and a hanging portion, the mounting portion is movably mounted within the mounting slot, the hanging portion cooperates with the second hanging-against structure on the side plate to hang the lid on the side plate.

In one embodiment, the mounting portion comprises a "T"-shaped body with a "T"-shaped cross-section, the "T"-shaped body is provided with a resilient buckle at the bottom thereof, when the first hanging-against structure is mounted within the mounting slot, the resilient buckle abuts against a flange of the opening portion of the mounting slot, and the "T"-shaped body is located within an opening of the mounting slot and abuts against a side wall of the flange of the mounting slot.

In one embodiment, the hanging portion comprises a main body and a hanging hook, one end of the main body is connected to the mounting portion and formed integrally, the other end of the main body extends toward two sides and forms one hanging hook on each side of the main body, each hanging hook cooperates with the hanging slot on the side plate respectively so as to hang the lid against the side plate.

In one embodiment, the second hanging-against structure is a hanging slot provided in the side plate, a bottom of the hanging slot forms a hanging platform, the hanging platform is provided with a stopping rib on the outside thereof, the stopping rib is provided with a through slot, the through slot cooperates with a middle of the main body, and an inner side of the stopping rib cooperates with the hanging hook.

In one embodiment, the inner side of the stopping rib forms an inclined surface or is provided with a first step and a second step, heights and positions of the first step and the second step are configured such that when the lid is completely hung on the side plate, the second protruding edge on the lid abuts against an outer side wall of the side plate.

In one embodiment, the container body comprises a pair of opposite first side plates and a pair of opposite second side plates, the second hanging-against structure is a hanging slot provided at the connection position of the first side plate and the second side plate, wherein each of two ends of the top of the first side plate are provided with one first recess respectively, and each of two ends of the top of the second side plate are provided with one second recess respectively, when the first side plate and the second side plate are connected with each other, the first recess is respectively joined with the adjacent second recess to form the hanging slot together.

In one embodiment, a bottom of the first recess forms a first part of the hanging platform, an outer side of the first recess forms a first part of the stopping rib, a bottom of the second recess forms a second part of the hanging platform, an outer side of the second recess forms a second part of the stopping rib, when the first side plate and the second side plate are connected with each other, the first part of the hanging platform is joined with the second part of the hanging platform to form a complete hanging platform together, the first part of the stopping rib is joined with the second part of the stopping rib to form a complete stopping rib together, and the through slot is formed between the first part of the stopping rib and the second part of the stopping rib; preferably, the through slot is formed in the second side plate.

In the present invention, since the first hanging-against structure on the lid is slidably connected with the lid, it can make the position of the center of gravity of the lid changes relative to the first hanging-against structure with the pushing-pulling of the lid, so as to realize the multi-directional hanging function of the lid and the container, and its structure is novel and reliable, simple and easy to operate, solid and durable.

EMBODIMENTS

Figure 1:
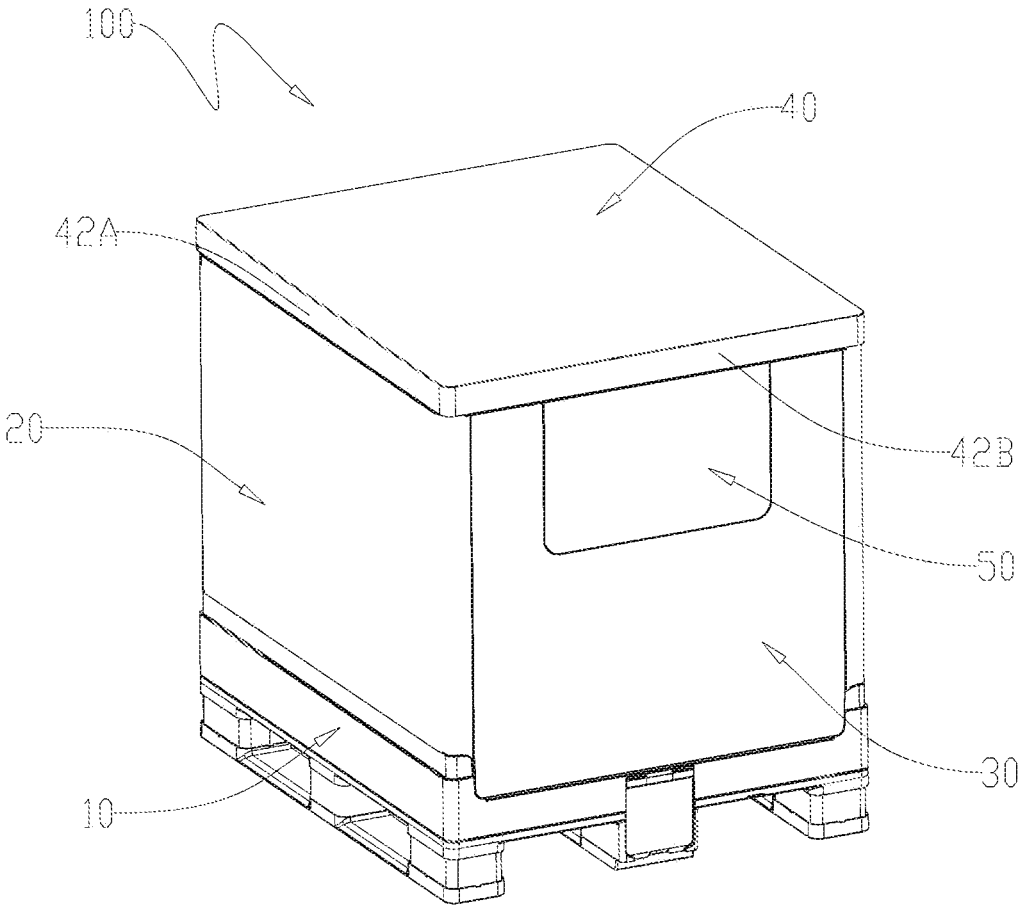
FIG. 1 is a perspective view of a container of an embodiment of the present invention, wherein the lid is in a closed state.

The preferred embodiment of this invention will be described in detail with reference to the accompanying drawings, so that the purposes, the characteristics and the advantages of the invention can be more clearly understood. It should be understood that the embodiments shown in the figures are not intended to limit the scope of this invention, but illustrate the essential spirit of the technical solution of this invention.

In the following description, certain specific details are set forth for purposes of illustrating the various disclosed embodiments to provide a thorough understanding of the various disclosed embodiments. However, those skilled in this art will recognize that embodiments may be practiced without one or more of these specific details. In other instances, well-known devices, structures, and techniques associated with the present application may not be shown or described in detail to avoid unnecessarily obscuring the description of the embodiments.

Throughout the specification "one embodiment" or "an embodiment" means that a particular characteristic, structure, or feature described in connection with the embodiment is included in at least one embodiment. Therefore, the presence of "in one embodiment" or "in an embodiment" at various locations throughout the specification need not all refer to the same embodiment. Additionally, particular characteristics, structures, or features may be combined in any manner in one or more embodiments.

In the following description, for clarity of illustration of the structure and mode of operation of the present invention, various directional terms will be used to describe the present invention, but words such as "front", "rear", "left", "right", "outer", "inner", "outward", "inward", "upper", "lower", and the like, should be understood as convenient terms and should not be construed as limiting terms.

The invention generally relates to a large container, its volume is generally more than 250 liters, and mainly used for cargo transportation and temporary storage, the large container ingeniously uses a function of guide rail formed by the protruding edge of the lid and the side plate of the container in the process of operating the container, together with the cooperation of the first hanging-against structure on the lid with the second hanging-against structure on the side plate, so as to achieve the hanging function of the lid relative to the side plate of the container. In particular, since the first hanging-against structure on the lid is slidably connected with the lid, the position of the center of gravity of the lid can be changed relative to the first hanging-against structure with the pushing-pulling of the lid, i.e., as the first hanging-against structure slides on the lid, the center of gravity of the lid can be changed from one side of the first hanging-against structure to the other side of the first hanging-against structure, thus realizing the double-directional hanging function of the lid and the container, and its structure is novel and reliable, simple and easy to operate, solid and durable. The following is a detailed description of one of the embodiments of the present invention in conjunction with the accompanying drawings.

Figure 2A:
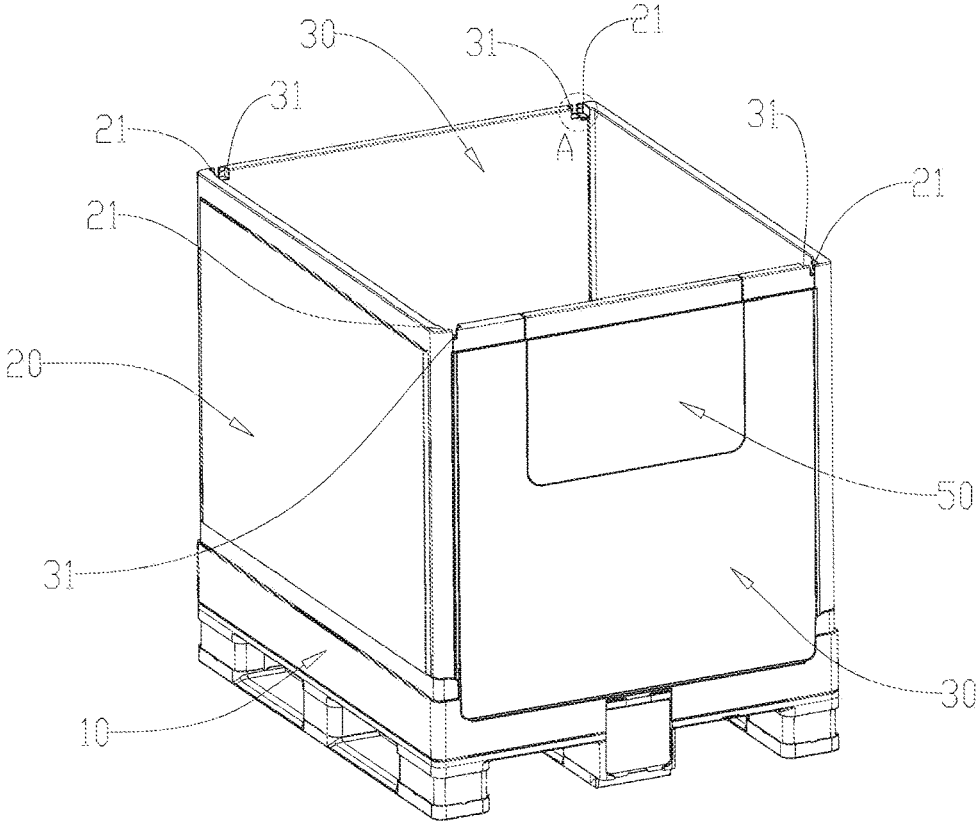
FIG. 2A is another perspective view of the container of FIG. 1, wherein the lid has been removed.

FIG. 1 is a perspective view of a container 100 of an embodiment of the present invention, wherein the lid is in a closed state, and FIG. 2A is another perspective view of the container 100 of FIG. 1, wherein the lid has been removed. As shown in FIG. 1-FIG. 2A, the container 100 generally comprises a base 10, a pair of opposite first side plates 20 and a pair of opposite second side plates 30, and a lid 40, optionally with a small door 50 in any one of the side plates. For the convenience of description, a sliding direction of the lid when it is opened is defined as a first direction herein, and a direction perpendicular to the first direction is defined as a second direction. The side plate arranged along the first direction is defined as a first side plate 20; and the side plate arranged along the second direction is defined as a second side plate 30. The side of one of the second side plates 30 beside which the operator stands when opening the lid is defined as a front side or a front end, and the side to which the other of the second side plates 30 opposite is defined as a rear side or a rear end. When the lid 40 needs to be opened, the operator stands beside the side of either of the two opposite second side plates 30 of the container 100, lifts the front end of the lid 40 and pushes it to slide toward the rear end.

Figure 2B:
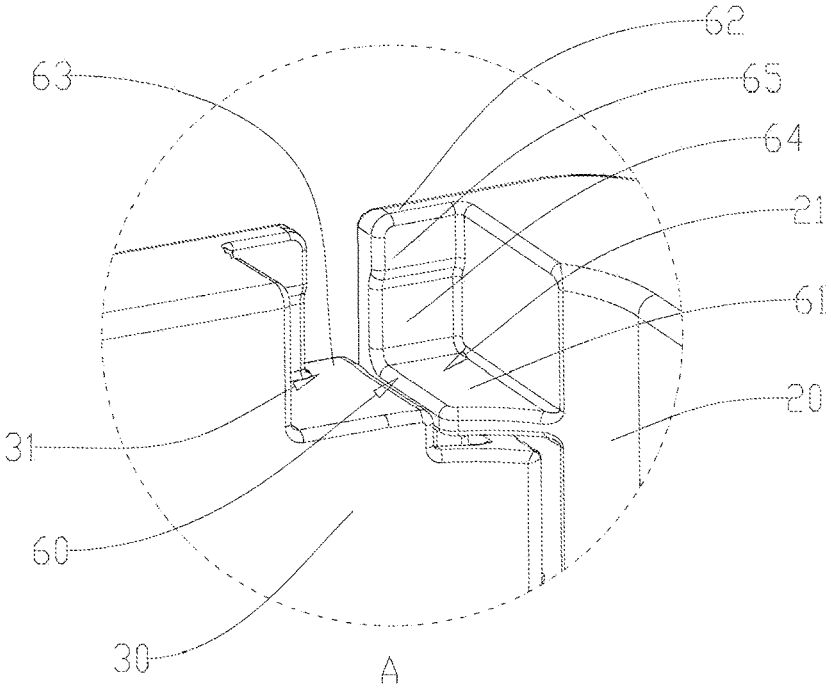
FIG. 2B is an enlarged view of part A of the container of FIG. 2A.

FIG. 2B is an enlarged view of part A of the container 100 of FIG. 2A. As shown in FIG. 2A-FIG. 2B, two ends of the top of the first side plate 20 are provided with one first recess 21 respectively, and two ends of the top of the second side plate 30 are provided with one second recess 31 respectively. When the first side plate 20 and the second side plate 30 are connected with each other, the first recess 21 and the corresponding second recess 31 are joined to form a hanging slot 60. A bottom of the hanging slot 60 forms a hanging platform 61, the hanging platform 61 is provided with a stopping rib 62 on the outside, the stopping rib 62 is provided with a through slot at the approximate middle position thereof. In particular, as shown in FIG. 2B, a first step 64 and a second step 65 are provided on the inner surface of the stopping rib 62, and heights and positions of the first step 64 and the second step 65 are strictly calculated so that when the lid 40 is completely hung on the second side plate 30, a second protruding edge 42B on the lid 40 abuts against the outer wall of the second side plate 30, and at this time, the lid 40 is in a tilted position, a hanging hook 721 on the first hanging-against structure 70 abuts against the first step 64 and second step 65 on the stopping rib 62, which increases the area of stress, improves the service life and enhances the stability of hanging of the lid.

Continuing to refer to FIG. 2B, in this embodiment, a bottom of the first recess 21 is formed with a first part of the hanging platform, an outer side of the first recess 21 is formed with a first part of the stopping rib, a bottom of the second recess 31 is formed with the second part of the hanging platform, and an outer side of the second recess 31 is formed with the second part of the stopping rib, and when the first side plate 20 and the second side plate 30 are connected with each other, the second recesses 31 located at the two ends of the top of the second side plate are joined with the corresponding first recesses 21 in the first side plate 20 respectively to form the hanging slot 60, the first part of the hanging platform is joined with the second part of the hanging platform to form a complete hanging platform 61, the first part of the stopping rib is joined with the second part of the stopping rib to form a complete stopping rib 62, and the through slot 63 is formed between the first part of the stopping rib and the second part of the stopping rib. Specifically, the through slot 63 is formed in the second side plate 30. Although in this embodiment, one hanging slot 60 is consisted by the first recess 21 provided in the first side plate 20 combining with a second recess 31 provided in the second side plate 30, that is, one hanging slot 60 is arranged in two side plates. It can be understood by those skilled in the art that one hanging slot 60 can also be only provided in the first side plate 20, especially when the side plates of the container cannot be folded with respect to the base.

Figure 3A:
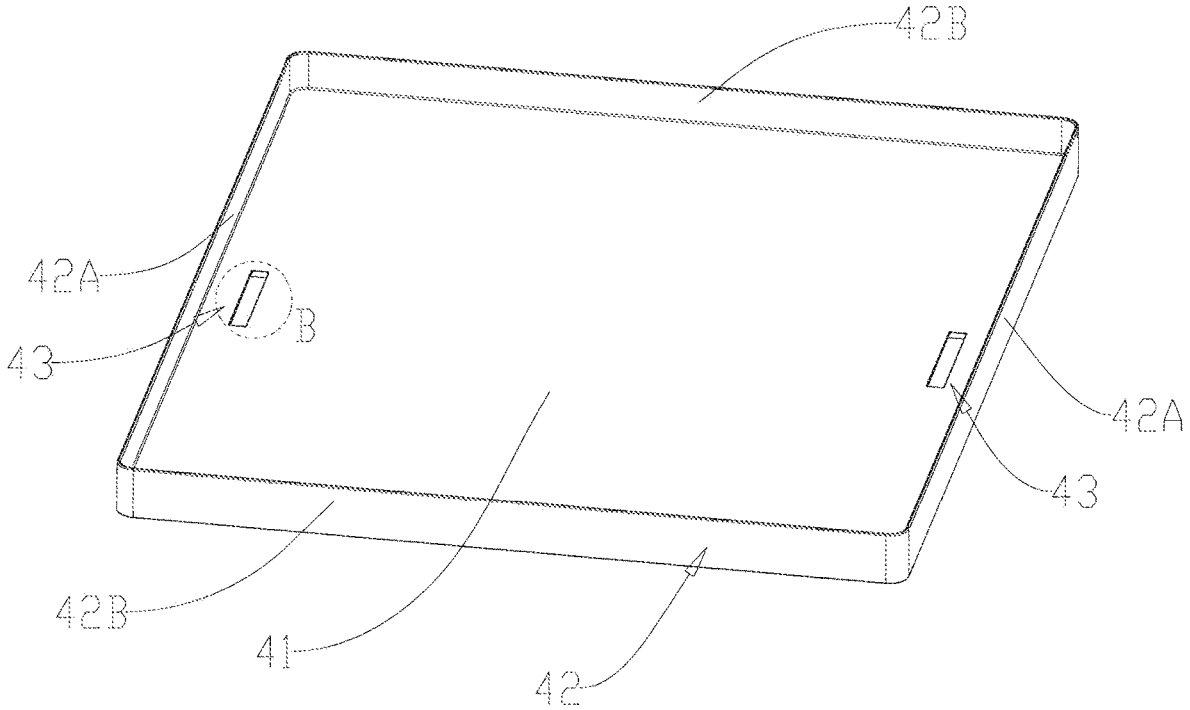
FIG. 3A is a perspective view of the lid of the container of FIG. 1.
Figure 3B:
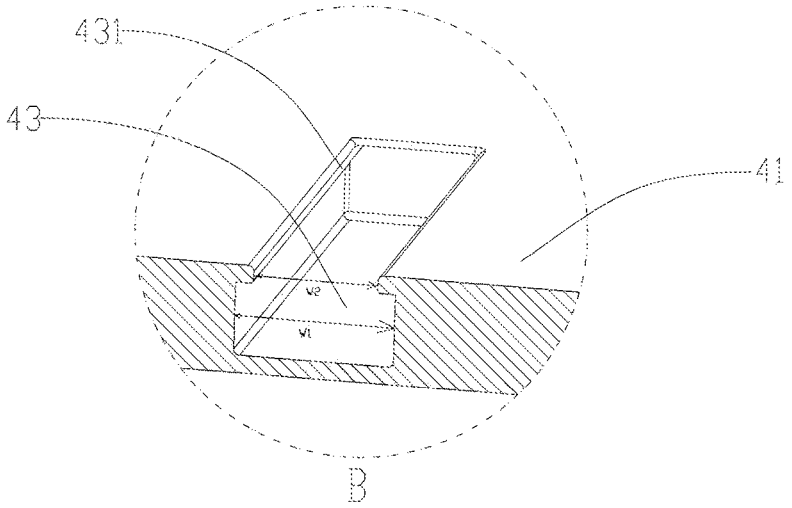
FIG. 3B is an enlarged sectional view of part B of FIG. 3A.

FIG. 3A is a perspective view of the lid 40, and FIG. 3B is an enlarged sectional view of part B of FIG. 3A. As shown in FIGS. 3A-3B, the lid 40 includes a lid body 41 and a protruding edge 42 provided around the circumference of the lid body 41. Specifically, for the convenience of description, a portion of the protruding edge 42 corresponding to a pair of opposite first side plates 20 is defined as a first protruding edge 42A, a portion of the protruding edge 42 corresponding to a pair of opposite second side plates 30 is defined as a second protruding edge 42B, the position where a pair of second protruding edges 42 B are located is defined as front-rear direction, and the position where a pair of first edges 42A are located is defined as left-right direction. It is clear from FIG. 3A and FIG. 1 that when the lid 40 of the container 100 is closed, the pair of first protruding edges 42A are located outside the pair of first side plates 20 and enclose the first side plates 20, and the pair of second protruding edges 42B are located outside the pair of second side plates 30 and enclose the pair of second side plates 30, such that the lid 40 of the container 100 encloses the four side plates as a whole.

Referring to FIG. 3A, two hanging-against structure mounting portions 43 are provided on a lower surface (i.e., a side facing the interior of the container) of the lid body 41. In this embodiment, the two hanging-against structure mounting portions 43 are mounting slots, which are respectively arranged on the inner side of a pair of opposite first protruding edges 42A in the left-right direction and extend in the front-rear direction, i.e., extend in a direction extending along the first protruding edge 42A, and two mounting slots 43 are arranged in the middle of the lid body 41 in the front-rear direction, that is, the two mounting slots 43 are provided at an intermediate position between the pair of opposite second protruding edges 42B of the lid body 41 and extend across a midline of the lid body 41 in the front-rear direction, i.e., a midline between the pair of opposite second protruding edges 42B, so as to ensure that when the first hanging-against structure is movably mounted in the hanging-against structure mounting portion 43, the first hanging-against structure can reciprocate within the mounting slot 43 and cross the midline of the lid body 41 in the front-rear direction, such that the lid 40 can be opened from the side on which either of the second side plates 30 is located and hung on the other of the second side plates 30.

Referring to FIG. 3B, the mounting slot 43 is recessed inwardly from the lower surface of the lid body 41 and has a length extending along the first protruding edge 42A and a width extending along the second protruding edge 42B, and the width W1 of a inner portion of this mounting slot 43 is greater than the width W2 of a opening portion thereof, i.e., a flange 431 protruding toward the center is formed in the opening portion such that the cross section of the mounting slot 43 forms a "T" shaped slot. When the first hanging-against structure 70 is mounted in the mounting slot 43, it can slide along the length of the mounting slot 43 and be limited by the flange 431 so that the first hanging-against structure does not come out of the mounting slot 43 during moving. This will be described in more detail below in connection with the specific structure of the first hanging-against structure 70.

Figure 4A:
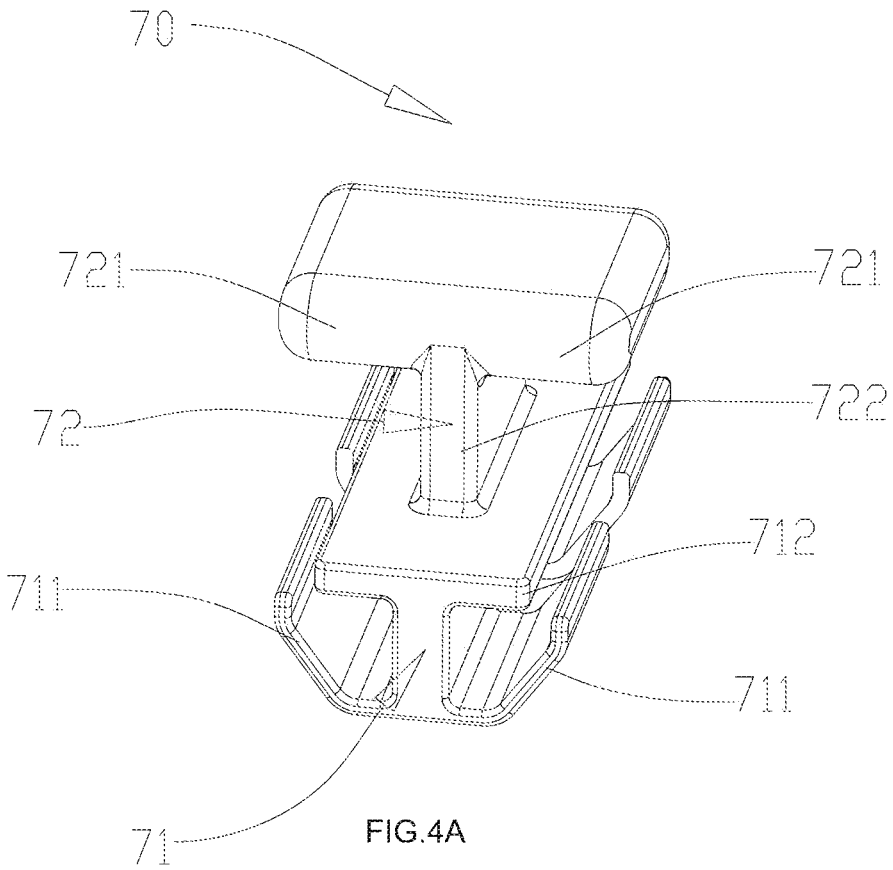
FIG. 4A is a perspective view of a first hanging-against structure of the container of FIG. 1.
Figure 4B:
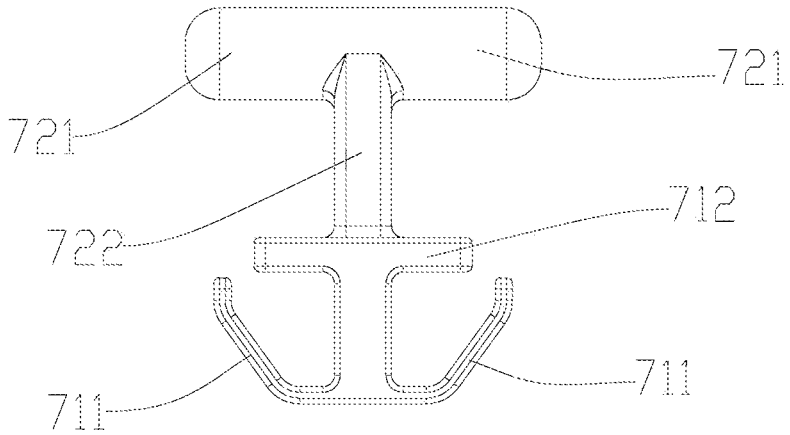
FIG. 4B is a front view of the first hanging-against structure of FIG. 4A.
Figure 5A:
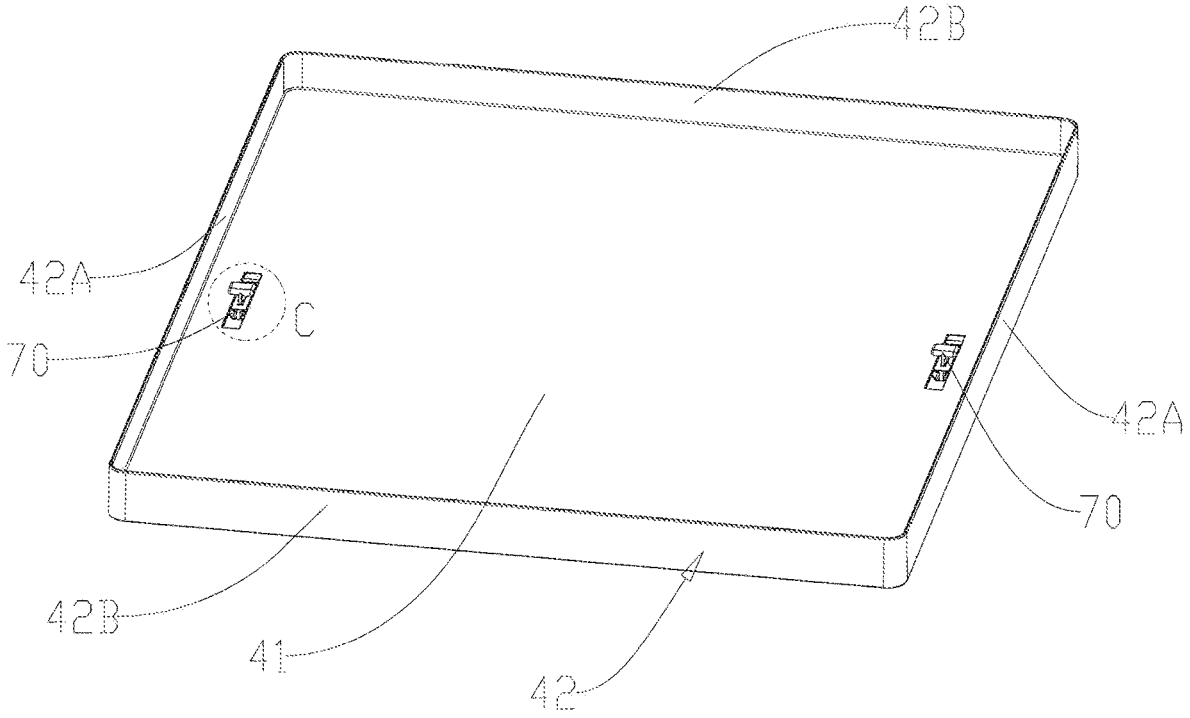
FIG. 5A is a perspective view of a lid mounted with a first hanging-against structure.
Figure 5B:
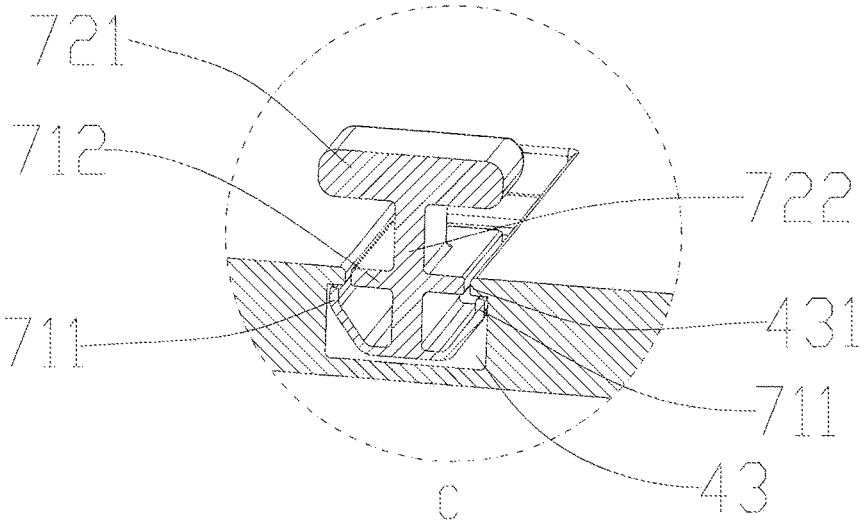
FIG. 5B is an enlarged sectional view of part C of FIG. 5A.

FIG. 4A is a perspective view of the first hanging-against structure 70, FIG. 4B is front view of the first hanging-against structure 70, FIG. 5A is a perspective view of the lid 40 mounted with the first hanging-against structure 70, and FIG. 5B is an enlarged sectional view of part C of FIG. 5A. As shown in FIGS. 4A-5B, the first hanging-against structure 70 includes a mounting portion 71 and a hanging portion 72, the mounting portion 71 is movably mounted in the mounting slot 43 of the lid 40, the hanging portion 72 cooperates with the hanging slot 60 in the side plate to achieve the purpose of hanging the lid 40 on the side plate, and since the mounting portion 71 is slidable in the mounting slot 43, during the process of lifting the lid 40 from one side and the lid 40 further sliding downward due to gravity, when the hanging portion 72 contacts the hanging platform 61 of the hanging slot 60, the first hanging-against structure 70 slides toward the previously lifted side of the lid 40, so that the center of gravity of the lid 40 is located on the unlifted side of the lid with respect to the first hanging-against structure 70, thereby enabling the lid to be stably hung on the side plate. And, in the process of lifting the lid 40 from the other side of the lid, the principle is the same and will not be repeated. Thereby, the present invention enables the lid 40 to be opened from either side of the opposite second side plates 30.

Continuing to refer to FIGS. 4A-4B, in this embodiment, the mounting portion 71 of the first hanging-against structure 70 includes a body 712 with a "T" shaped cross section, and a resilient buckle 711 with a "U" shaped cross section is provided at the bottom of the "T" shaped body 712. The advantage of this design is that, referring to FIG. 5B, when the first hanging-against structure 70 is assembled into the mounting slot 43 in the lid 40, the resilient buckle 711 on the first hanging-against structure 70 abuts against the flange 431 on the upper edge of the mounting slot 43, thereby completing the installation of the first hanging-against structure 70, at the same time, the "T"-shaped body 712 of the first hanging-against structure 70 is located just inside the opening portion of the mounting slot 43 of the lid 40 and abuts against the side wall of the flange 431 of the mounting slot 43, preventing the first hanging-against structure 70 from tilting and swaying during the sliding process. The hanging portion 72 is integrally formed with the body 712 of the mounting portion 71 and they form a structure with a "T" shaped cross-section as a whole. Specifically, the hanging portion 72 includes a main body 722 and a hanging hook 721, one end of the main body 722 and the body 711 of the mounting portion 71 are connected and integrally formed, and the other end of the main body 722 extends toward two sides and forms one hanging hook 721 on each side of the main body 721, and each hanging hook 721 respectively cooperates with the hanging slot of the second side plate 30 on the same side so as to hang the lid 40 against this second side plate 30, and it should be noted that the lid of the container of the present invention can be opened in both directions, so that when the lid 40 is opened from different sides of the container 100, one of the hanging hooks respectively cooperates with the hanging slot on the opposite side plate to achieve hanging.

Figure 6:
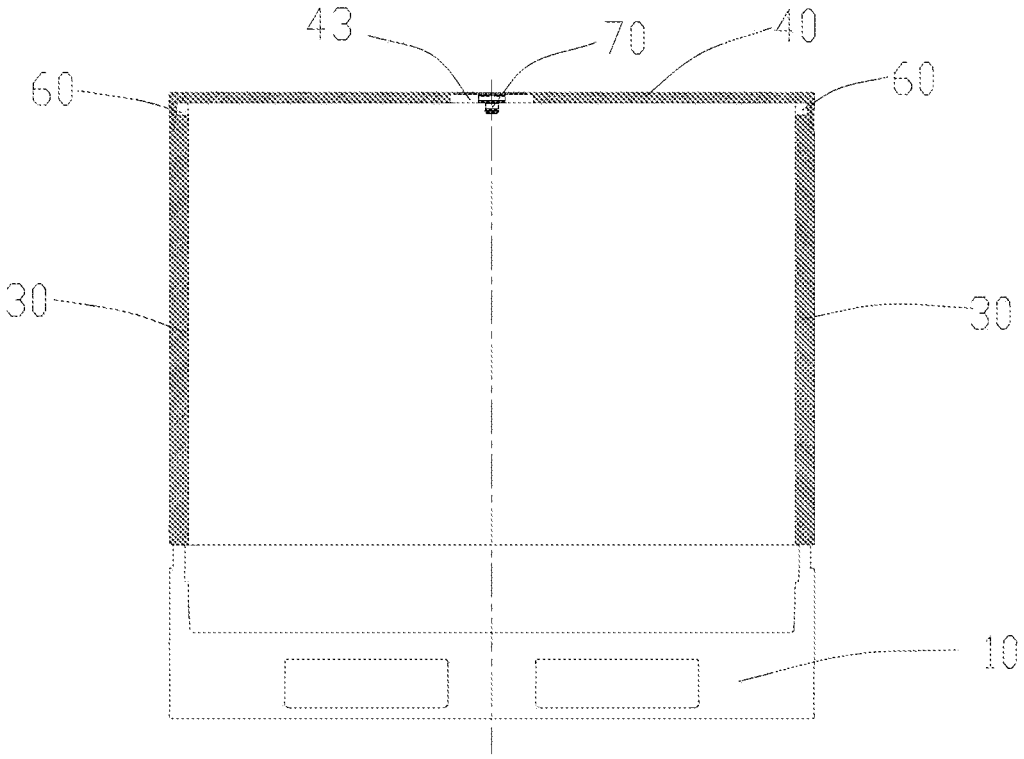
FIG. 6 is a cross-sectional view of a container of an embodiment of the present invention, with the lid in a closed state.
Figure 7A:
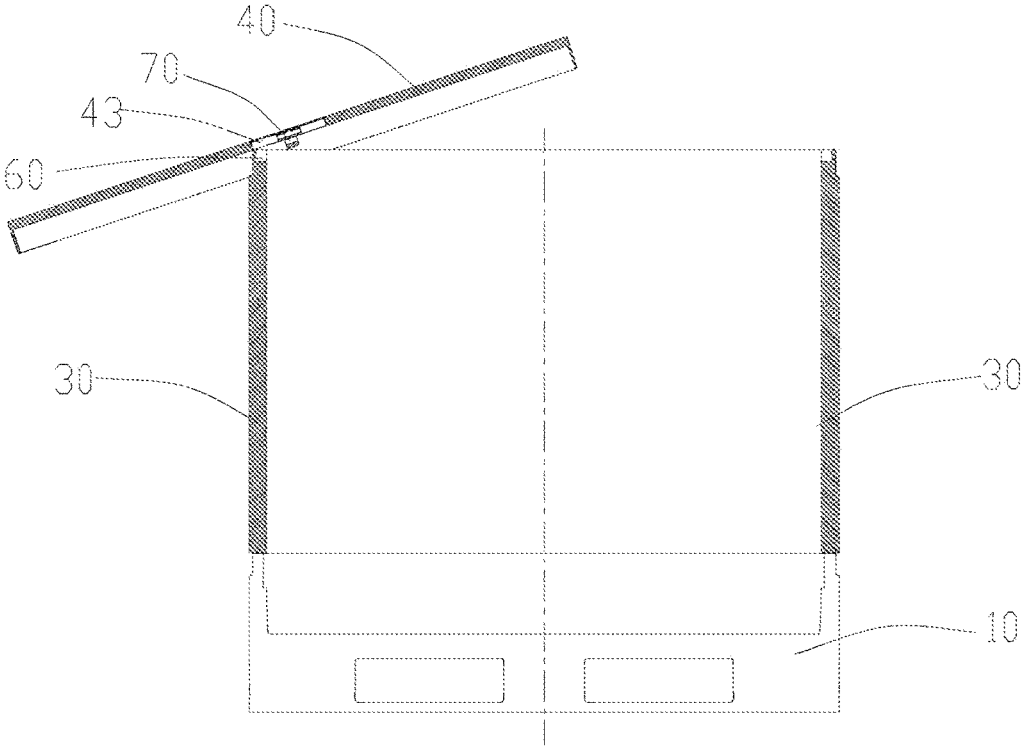
FIG. 7A is a cross-sectional view of a container of an embodiment of the present invention, with the lid in a half-opened state and the first hanging-against structure being not in contact with the hanging slot.
Figure 7B:
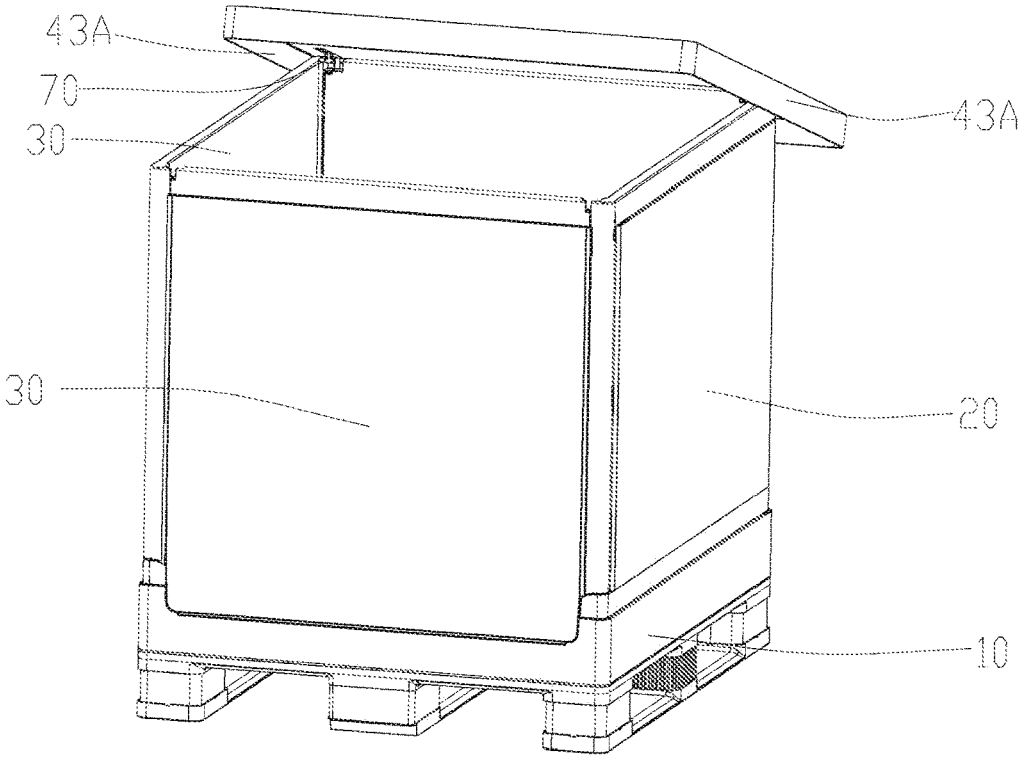
FIG. 7B is a perspective view of the container of FIG. 7A.
Figure 8A:
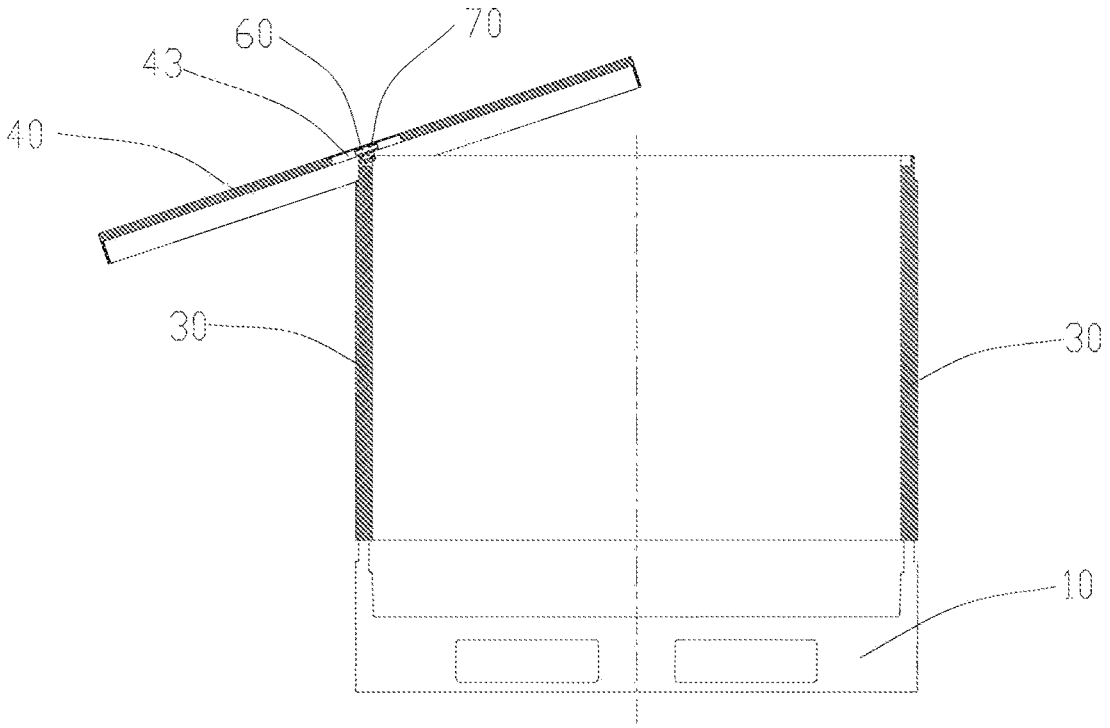
FIG. 8A is a cross-sectional view of a container of an embodiment of the present invention, with the lid in a half-opened state and the first hanging-against structure beginning to contact with the hanging slot.
Figure 8B:
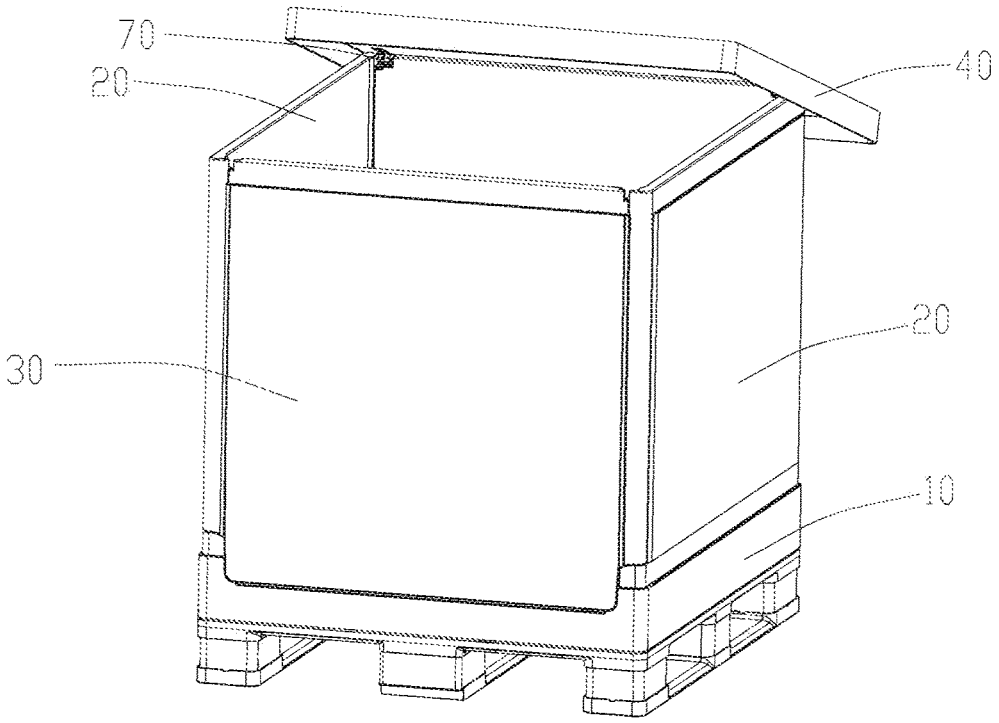
FIG. 8B is a perspective view of FIG. 8A.
Figure 9:
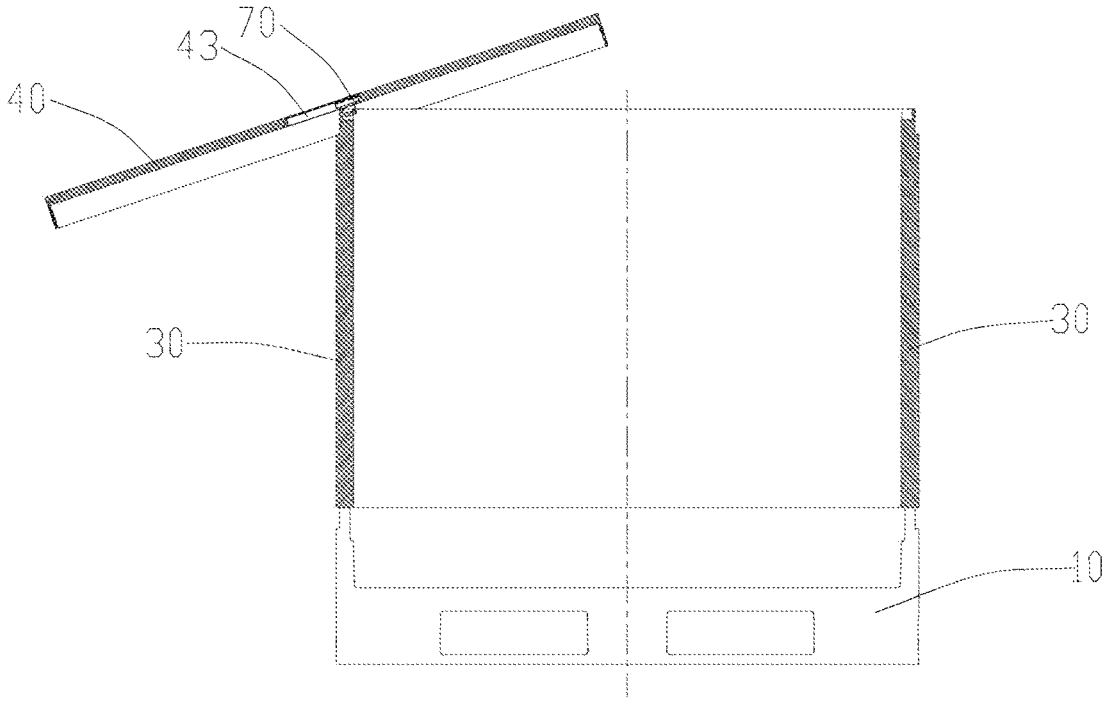
FIG. 9 is a cross-sectional view of a container of an embodiment of the present invention, with the lid in a half-opened state and the first hanging-against structure stuck into the hanging slot.
Figure 10A:
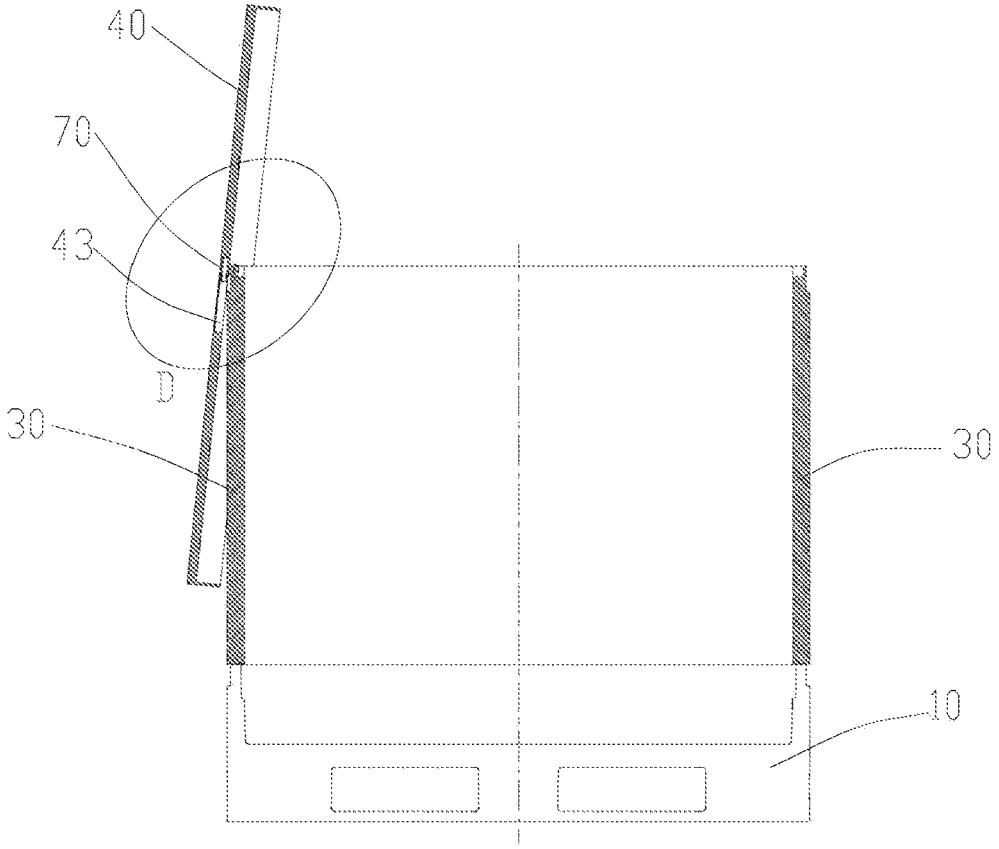
FIG. 10A is a cross-sectional view of a container of an embodiment of the present invention, with the lid in the opened state and hung against the side plate.
Figure 10B:
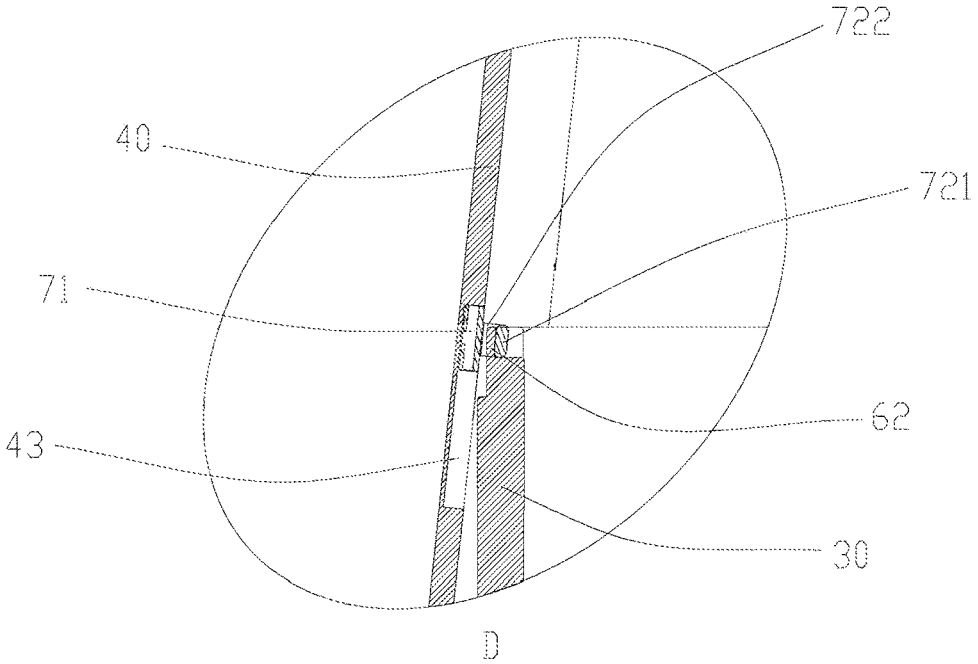
FIG. 10B is an enlarged view of part D of the container of FIG. 10A.
Figure 10C:
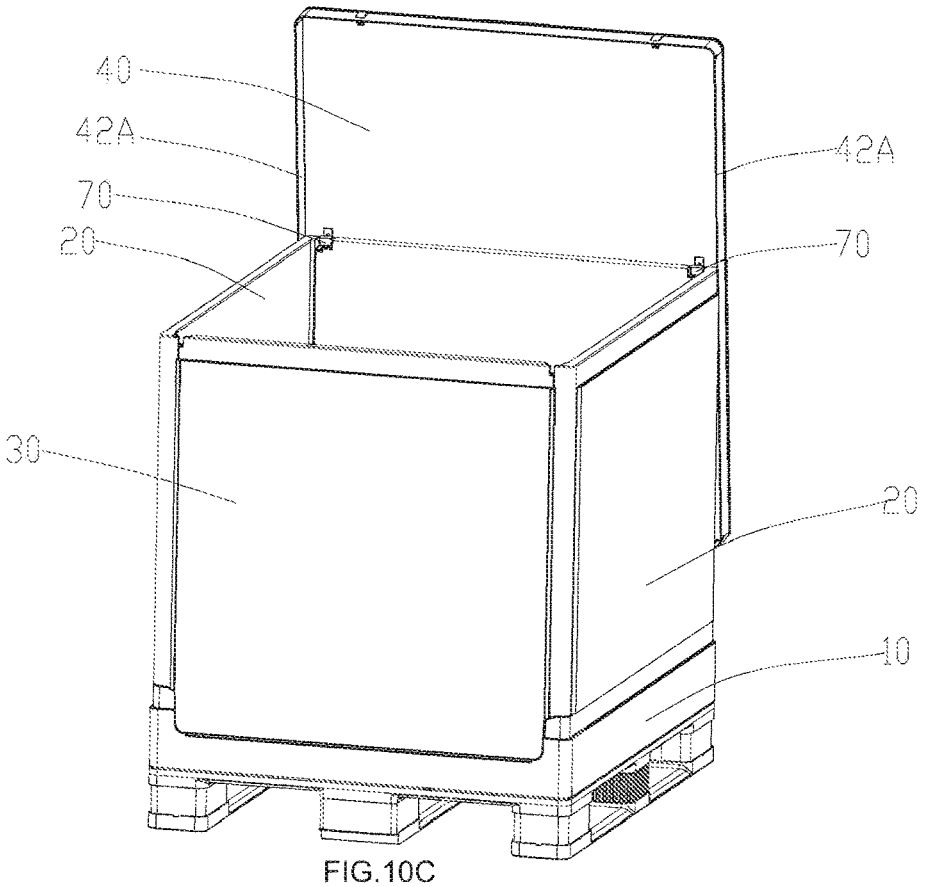
FIG. 10C is a perspective view of the container of FIG. 10A.

FIG. 6-FIG. 10C show the process of the lid 40 from closing to opening and finally hanging on the side plate, wherein FIG. 6 is a sectional view of the container 100 with the lid in the closed state; FIG. 7A is a sectional view of the container 100 with the lid in the half-opened state and the first hanging-against structure being not in contact with the hanging slot; FIG. 7B is a perspective view of the container 100 of FIG. 7A; FIG. 8A is a sectional view of the container 100 with the lid in a half-opened state and the first hanging-against structure beginning to contact with the hanging slot; FIG. 8B is a perspective view of FIG. 8A; FIG. 9 is a cross-sectional view of container 100 with the lid in a half-opened state and the first hanging-against structure stuck into the hanging slot; FIG. 10A is a cross-sectional view of container 100 with the lid in an opened state and hung against the side plate; FIG. 10B is an enlarged view of part D of the container of FIG. 10A, and FIG. 10C is a perspective view of FIG. 10A. The process of opening the lid of the container 100 of this embodiment is described below with reference to FIG. 6-FIG. 10C.

As shown in FIG. 6, when the lid 40 is in the closed state, the first hanging-against structure 70 is mounted within the mounting slot 43 of the lid 40 and is located in the midplane between a pair of second side plates 30 (the plane shown by the dotted line in FIG. 6), and it is clear from FIG. 6 that the length of the first hanging-against structure 70 is less than that of the mounting slot 43, and the first hanging-against structure 70 can slide to the left and across the midplane as shown in FIG. 6 or slide to the right and across the midplane. As shown in FIGS. 7A-7B, the operator stands beside one side of one of the second side plates 30, such as the front side shown in FIG. 7B, and when the lid 40 needs to be hung, the operator only needs to lift the front end of the lid 40 and make it slide toward the rear end, and during the process of sliding the lid 40 toward the rear end, the two opposite second protruding edges 42B of the lid 40 always remain in contact with the two first side plates 20 of the container, thereby playing a role similar to that of a guide rail. It is finally ensured that the first hanging-against structure 70 on the lid 40 slides into the hanging slot 60 in the side plate to complete the hanging operation of the lid 40.

As shown in FIGS. 8A-8B, in the process of opening the lid for hanging, when the first hanging-against structure 70 in the lid 40 begins to contact with the hanging slot 60 in the side plate, because the first hanging-against structure 70 can slide in the mounting slot 43 by a certain distance, the lid 40 will continue to slide forward due to inertia, and when it reaches the sliding terminus, as shown in FIG. 9, the first hanging-against structure 70 slides to one end of the mounting slot 43, at this time, the center of gravity of the lid 40 moves to the other side of the first hanging-against structure 70, due to gravity, the lid 40 is rotated around a contact point of the first hanging-against structure and the hanging platform 61 as the center of a circle, as shown in FIGS. 10A, 10B and 10C, until rotated to make the second protruding edge 42B of the lid 40 contact the second side plate 30 of the container, the lid 40 stops rotating and remains stationary, thus completing the hanging operation of the lid. At this time, the lid 40 is completely hung on the second side plate 30, and the second protruding edge 42B of the lid 40 abuts against the outer side wall of the second side plate 30, at this time the lid 40 is in an inclined state, and the hanging hook 721 on the first hanging-against structure 70 abuts against the first step 64 and the second step 65 on the stopping rib 62 on the second side plate 30, thereby increasing the area of stress, improving the service life, enhancing the stability of hanging of the lid, and preventing the lid from easily falling off during possible vertical vibration or moving of the container.

It should be noted that, in another embodiment, instead of providing the first step 64 and the second step 65 on the inner surface of the stopping rib 62, the inner surface of the stopping rib 62 can also be set as an inclined surface, a bottom of the inclined surface is close to the outer side of the side plate and its top is far away from the side plate, that is, the stopping rib 62 forms a structure with a thicker upper part and a thinner lower part. The angle of the inclined surface is preferably set such that the inclined surface is parallel to a top surface of the lid after the lid is hung against it.

It should be noted that, although in the above embodiment, the circumference of the body of the lid is provided with the protruding edge and the protruding edge acts as a sliding rail during the opening and sliding of the lid, however, it can be understood by those skilled in the art that the lid can also be provided without a protruding edge, but a guide rail is formed at the bottom or side of the lid to cooperate with the side plate to achieve the sliding of the lid.

In addition, the container of the present invention may be a foldable container, i.e. the side plates can be folded with respect to the base, in this case the second hanging-against structure on the side plates is preferably provided on two adjacent side plates at the same time. However, the container of the present invention may also be a non foldable container, in this case the second hanging-against structure on the side plate may be only provided on one of the side plates.

In summary, in the present invention, since the first hanging-against structure on the lid is slidably connected with the lid, it can make the position of the center of gravity of the lid change relative to the first hanging-against structure with the pushing-pulling of the lid, so as to realize the multi-directional hanging function of the lid and the container, and its structure is novel and reliable, simple and easy to operate, solid and durable.

The preferred embodiments of the present invention have been described in detail, but it should be understood that, after reading the above teachings of the present invention, various modifications or modification of the present invention can be made by those skilled in the art. These equivalent forms are also within the scope defined by the claims appended hereto.

The invention claimed is:

1. A container comprising a container body and a lid, the container body comprising a base and side plates, wherein the lid is provided with a first hanging-against structure, at least one pair of opposite side plates are respectively provided with a second hanging-against structure cooperating with the first hanging-against structure, the first hanging-against structure and the second hanging-against structure are separatable to achieve hanging-against and removal of the lid, the lid is slidable above the container body whereby the first hanging-against structure and the second hanging-against structure are brought close to or away from each other, wherein the first hanging-against structure is slidable along the lid for a certain distance so that the position of the center of gravity of the lid changes relative to the first hanging-against structure, wherein the lid comprises a lid body and two opposite first protruding edges and two opposite second protruding edges surrounding the lid body, a lower surface of the lid is provided with a mounting slot, which has a length extending along the first protruding edge, the first hanging-against structure is movably arranged within the mounting slot such that it is movable along a length direction of the mounting slot for a certain distance, wherein the mounting slot is provided on the middle of inner side of the first protruding edge and spans a midpoint of the first protruding edge.

2. A container according to claim 1, wherein the first hanging-against structure comprises a hanging hook, the second hanging-against structure comprises a hanging slot provided in the side plate; or the first hanging-against structure comprises a hanging slot, the second hanging-against structure comprises a hanging hook provided on the side plate.

3. A container according to claim 1, wherein the first hanging-against structure is provided on an inner side of each of the two opposite first protruding edges.

4. A container according to claim 1, wherein the mounting slot is recessed inwardly from the lower surface of the lid body, and a width of a body portion of the mounting slot is greater than that of an opening portion thereof so as to form a flange protruding toward a center in the opening portion.

5. A container according to claim 1, wherein the first hanging-against structure comprises a mounting portion and a hanging portion, the mounting portion is movably mounted within the mounting slot, the hanging portion cooperates with the second hanging-against structure on the side plate to hang the lid on the side plate.

6. A container according to claim 5, wherein the mounting portion comprises a "T"-shaped body with a "T"-shaped cross-section, the "T"-shaped body is provided with a resilient buckle at the bottom thereof, when the first hanging-against structure is mounted within the mounting slot, the resilient buckle abuts against a flange of the opening portion of the mounting slot, and the "T"-shaped body is located within an opening of the mounting slot and abuts against a side wall of the flange of the mounting slot.

7. A container according to claim 6, wherein the hanging portion comprises a main body and a hanging hook, one end of the main body and the mounting portion are connected and formed integrally, the other end of the main body extends toward two sides and forms one hanging hook on each side of the main body, each hanging hook cooperates with the hanging slot on the side plate respectively so as to hang the lid against the side plate.

8. A container according to claim 7, wherein the second hanging-against structure is a hanging slot provided in the side plate, a bottom of the hanging slot forms a hanging platform, the hanging platform is provided with a stopping rib on the outside thereof, the stopping rib is provided with a through slot, the through slot cooperates with a middle of the main body, and an inner side of the stopping rib cooperates with the hanging hook.

9. A container according to claim 8, wherein the inner side of the stopping rib forms an inclined surface or is provided with a first step and a second step, heights and positions of the first step and the second step are configured such that when the lid is completely hung on the side plate, the second protruding edge on the lid abuts against an outer side wall of the side plate.

10. A container according to claim 8, wherein the container body comprises a pair of opposite first side plates and a pair of opposite second side plates, the second hanging-against structure is a hanging slot provided at the connection position of the first side plate and the second side plate, wherein each of two ends of a top of the first side plate are provided with one first recess respectively, and each of two ends of a top of the second side plate are provided with one second recess respectively, when the first side plate and the second side plate are connected with each other, the first recess is respectively joined with the adjacent second recess to form the hanging slot together.

11. A container according to claim 10, wherein a bottom of the first recess forms a first part of the hanging platform, an outer side of the first recess forms a first part of the stopping rib, a bottom of the second recess forms a second part of the hanging platform, an outer side of the second recess forms a second part of the stopping rib, when the first side plate and the second side plate are connected with each other, the first part of the hanging platform is joined with the second part of the hanging platform to form a complete hanging platform together, the first part of the stopping rib is joined with the second part of the stopping rib to form a complete stopping rib together, and the through slot is formed between the first part of the stopping rib and the second part of the stopping rib; preferably, the through slot is formed in the second side plate.

* * * * *